US005595498A

United States Patent [19]

Jego et al.

[11] Patent Number: 5,595,498

[45] Date of Patent: Jan. 21, 1997

[54] CONNECTOR FOR ELECTRICAL TRUNKING

[75] Inventors: Gérard Jego, Brazey en Plaine; Daniel Nourry, Dijon; Jean-Pierre Thierry, Arc Sur Tille, all of France

[73] Assignee: Schneider Electric SA, Boulogne-Billancourt, France

[21] Appl. No.: 397,368

[22] Filed: Mar. 2, 1995

[30] Foreign Application Priority Data

Mar. 2, 1994 [FR] France ..... 94 02493

[51] Int. Cl.[6] ..... H01R 4/50

[52] U.S. Cl. ..... 439/342; 439/216; 439/324

[58] Field of Search ..... 439/345, 350, 439/352, 353, 357, 358, 342, 343, 117, 259, 324, 216

[56] References Cited

U.S. PATENT DOCUMENTS 3,564,482 2/1971 Yamanaka et al. ..... 439/343

FOREIGN PATENT DOCUMENTS 0077242 4/1983 European Pat. Off. .
1287667 1/1969 Germany .
8227645 1/1983 Germany .
2262399 6/1993 United Kingdom .

*Primary Examiner*—Neil Abrams
*Assistant Examiner*—Yong Kim
*Attorney, Agent, or Firm*—Oblon, Spivak, McClelland, Maier & Neustadt, P.C.

[57] ABSTRACT

Connector for electrical trunking containing parallel conductors accommodated in an enclosure. The body of the connector is associated with a latch which can be locked manually and preferably released by use of a tool. The latch cooperates with a contact block accommodated in the enclosure in order to operate lugs which guide and/or lock the connector.

9 Claims, 3 Drawing Sheets

FIG. 5
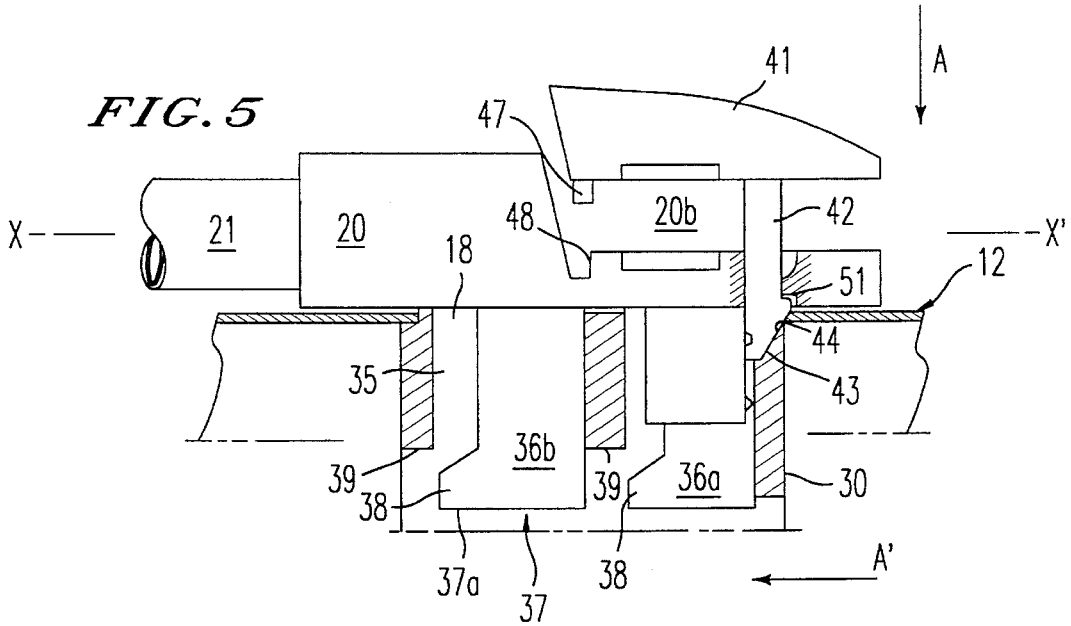
FIG. 6
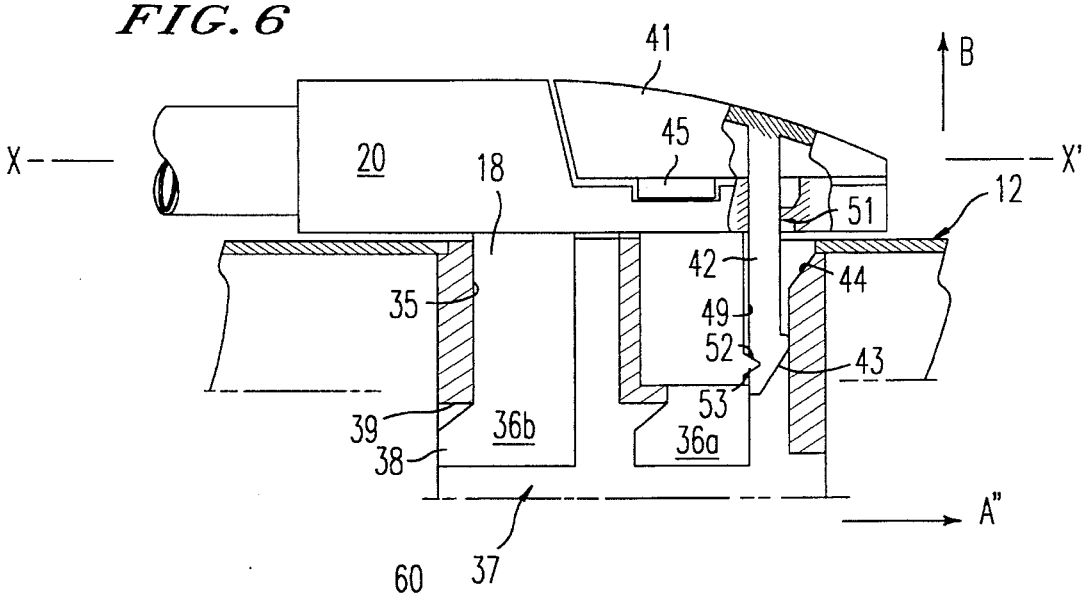
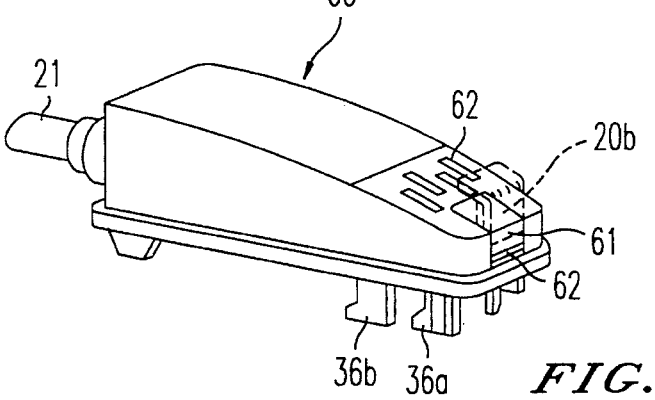
FIG. 7

CONNECTOR FOR ELECTRICAL TRUNKING

BACKGROUND OF THE INVENTION

1. Field of the Invention

The present invention concerns a connector for electrical trunking of the kind containing a plurality of parallel conductors accommodated in a rigid enclosure and branch contact blocks inside the enclosure facing openings in one wall of the latter.

2. Discussion of the Background

Patent EP-77 242 describes a connector of this kind including a body provided with terminals connecting to regions of the conductors accommodated in the contact block and a branch cable connector connected to the terminals.

To make a branch connection it is desirable for a connector of this kind to be accommodated in and locked into a respective contact block in order to provide a permanent and reliable connection to the trunking. Also, if locking is to be effected by deliberate manual action it is desirable to prevent unintentional releasing of the connector.

SUMMARY OF THE INVENTION

One object of the invention is to procure simple mechanical locking of a connector attached to electrical trunking. Another object of the invention is to prevent unintentional release of the connector.

In accordance with the invention, a manually movable latch is associated with the connector body and adapted to cooperate with a component of the contact block to operate means for locking the connector to the contact block.

The latch preferably has a plunger part which in the locked position is engaged in a housing of the connector body in such a way as to prevent access to and manual release of the latch.

BRIEF DESCRIPTION OF THE DRAWINGS

One non-limiting embodiment of the invention will now be described with reference to the figures.

FIGS. 5 and 6 are side views of the connector engaged in the contact block and shown respectively in an unlocked position and a locked position.

FIG. 7 is a perspective view of an alternative embodiment of the connector.

DESCRIPTION OF THE PREFERRED EMBODIMENTS

Figure 1:
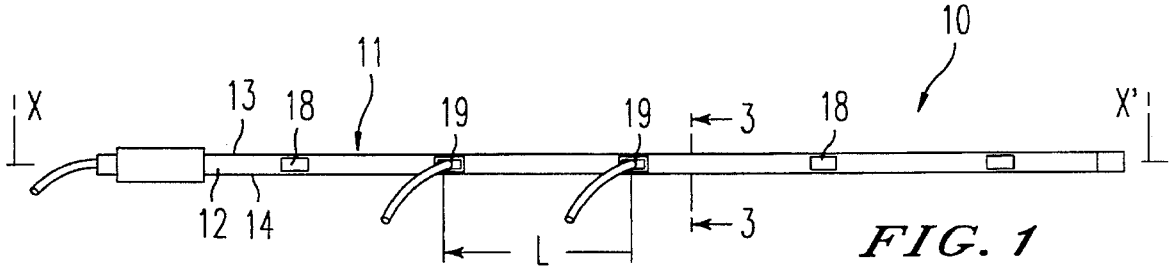
FIG. 1 shows prefabricated electrical trunking fitted with connectors.
Figure 2:
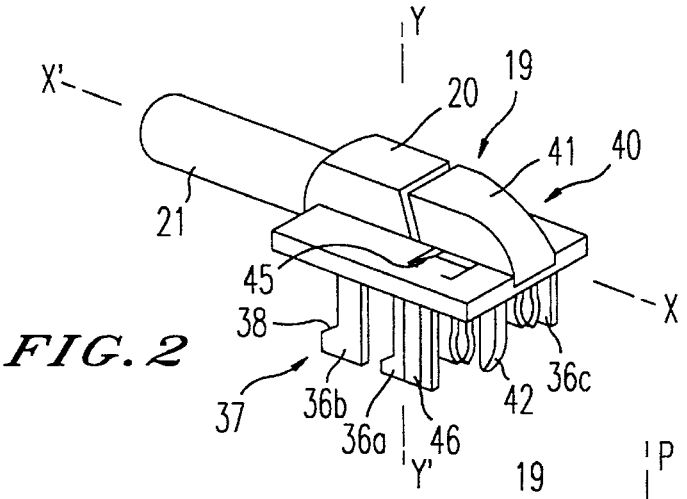
FIG. 2 is a perspective view of a connector in accordance with the invention.

The prefabricated electrical trunking 10 shown in FIG. 1 comprises a certain number of sections the same length assembled together end-to-end along a longitudinal axis X-X' thereof. For simplicity only one section is shown. Each trunking section comprises a metal enclosure 11 with a rectangular cross-section, preferably a square cross-section for optimum stiffness, with four walls 12, 13, 14, 15, accommodating a plurality of parallel electrical connector cables or busbars 16, in this example in the form of a flat bundle 17 of four conductors. Generally rectangular openings 18 are formed in the wall 12 at regular intervals L. The purpose of these openings is to receive branch connectors 19 for supplying power to loads (not shown) from the conductors 16. The connectors 19 have an insulative body 20, an outlet cable 21 and connecting terminals, which are in the form of elastic clips 22, for example, adapted to engage with bared parts 16*a* of the conductors 16 to make the electrical connection between the latter and the outlet cable. In this example the conductors 16 are sheathed flexible cables bared only at the openings 18, but they can equally well comprise bare or sheathed metal strips or busbars.

Figure 3:
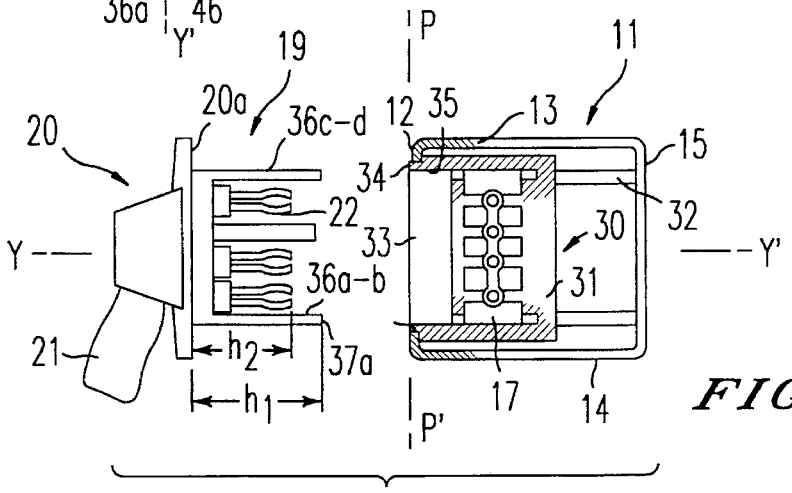
FIGS. 3 and 4 are views of the trunking in section taken along line 3—3 and in FIG. 1 on an enlarged scale in which the connector is respectively shown separate from the branch contact block and engaged therein.
Figure 4:
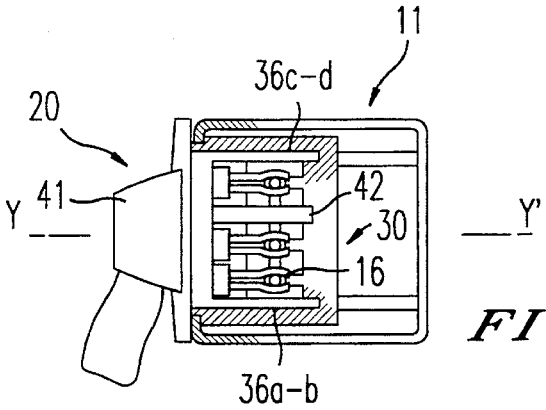

Each opening 18 is associated with a branch contact block 30 adapted to position the parallel conductor 16 inside the enclosure facing the opening and to enable the connector 19 to be fitted. The contact block 30 has a body 31, means 32 for holding it in position in the enclosure and, on the side towards the opening 18, a housing 33 adapted to receive part of the connector and flanked towards the opening 18 by a flange 34 whose outside is substantially flush with the outside face of the wall 12 in the plane P-P'. The housing 33 includes wells 35 providing guide surfaces for guide and/or locking lugs 36*a–d* of the connector and the flat bundle of conductors 16 is placed in this housing. The bared parts 16*a* of the parallel conductors 16 are arranged in front of the opening 18 so that the connecting terminals or clips 22 can be engaged on them when the connector is pushed into the housing 33. Relative to the plane of a baseplate 20*a* of the body which is against the wall 12 in the connection position; the lugs 36 of the connector have a height h1 greater than the height h2 of the terminals 22 (FIG. 3); the lugs 36 therefore allow the connector to slide on the wall 12 before it engages in the space 33, protect the terminals laterally and guide the connector when it is inserted in the space 33; the lugs 36 have at their free end 37 attachment heelpieces 38 which widen in the direction A' (FIG. 5) and are adapted to cooperate with stop members 39 provided in the contact block, discussed below, to prevent manual disconnection of the connector in the direction Y-Y' perpendicular to the P-P'; at their end 37 the lugs 36 have faces 37*a* adapted to slide on the wall 12 of the enclosure of the trunking.

The body 20 of the connector 19 is associated with a manual latch 40 which includes a part 41 for holding it and pushing it joined to a finger 42 which has a cam or ramp surface 43 adapted to cooperate with an edge, a ramp surface or a shoulder 44 on the contact block. The latch 40 can assume an unlocked position (FIG. 5) and a locked position (FIG. 6), moving from the former position to the latter position when manual pressure is applied to the operating part 41 movable in the direction Y-Y' (arrow A) and from the latter position to the former position by inserting a tool in a lateral notch 45 in the member and raising the latter in the direction Y-Y' (arrow B). A conductive strip 46 on the outside face of one of the guide and attachment fingers 36 provides grounding by contact with an electrically conductive member inside the contact block when the connector is engaged in the latter.

In an inward locked position the holding part 41 is situated in an external housing 20*b* on the connector body to form a streamlined shape with the remainder of the body. It has a lug 47 adapted to engage in a notch 48 on the connector body 20. The finger 42 is guided in a well 49 in the body 20 and has in addition to the ramp surface 43 a shoulder 50 which cooperates with an abutment 51 on the body 20 to limit displacement of the latch in the direction B and a recess 52 adapted to cooperate in the locked and/or the unlocked position with a tip 53 on the connector body 20 to hold the latch in that position.

FIG. 7 shows an alternative embodiment of the connector of the invention. The connector body 60 is associated with a manually operable latch 61 in the form of a plunger similar to that already described but adapted to be unlocked by inserting a tool into a front slot 62, i.e. at the front of the body, to move it to the unlocked position shown in dashed outline. The body contains fuses on the electrical path connecting the cables 21 to the terminals 22 and slots 62 through which the status of the connecting terminals 22 can be seen. In the locked position the latch 61 is accommodated, like the member 40, in a space **20*b*** of the body such that the profile of the latch plunger and the profile of the body are continuous.

Operation of the connector of the invention will now be described with reference to the embodiment shown in FIGS. 2 through 6.

The connector 19 is offered up to the opening 18 in the electrical trunking 10 either from the front (FIG. 3) or by sliding the lugs 36 along the wall 12, in the latter case to facilitate mounting it "blind", i.e. when it cannot be seen. When the ends 37 of the lugs **36*a–d* are in front of the corresponding wells 35 of the housing 33 (as shown in dashed outline in FIG. 5) the connector can be pushed into the housing in the direction of the arrow A; the downward movement of the connector is guided by the lugs 36 remaining in contact with the surfaces delimiting the wells 35 until the baseplate 20*a* of the connector body abuts on the wall 12. At this time the latch is certain to be in its unlocked position as shown in FIG. 5; if it were not in this position before insertion, it would be moved into this unlocked position by abutment of the ramp surface 43 against the shoulder 44 on the contact block 30** during its downward movement.

To lock the connector the operator then presses on the member 40 in the direction of the arrow A. The ramp surface 43 of the finger 42 moves against the shoulder 44, entraining the connector as a whole in the direction of the arrow A' until the heelpieces 38 engage under the stop members 39; the fingers 42 move downwards in the wells 49 until the members 52, 53 are locked; the connector can move because the lugs 36 are narrower in the direction X-X' than their heelpieces 38.

The operator cannot unlock the connector manually, and to unlock it must insert a tool into one of the slots 45 to release the member 40; when the ramp surface 43 has been disengaged from the well 49 the connector body can be moved in the direction A" opposite to the direction A' as far as the position shown in FIG. 5, and then extracted from the housing 43 in the direction B opposite to direction A.

Figure 8:
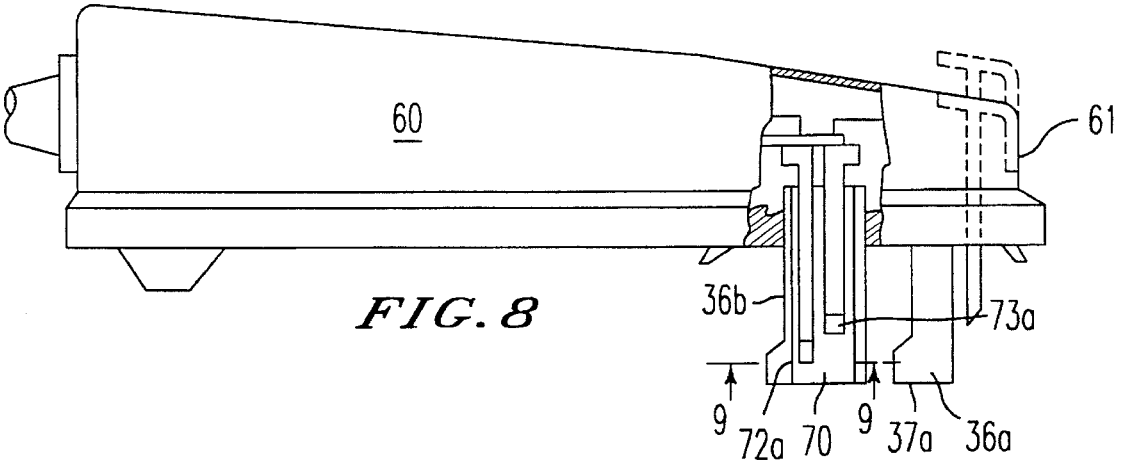
FIG. 8 is an elevation view partly in section of the connector from FIG. 7.
Figure 10:
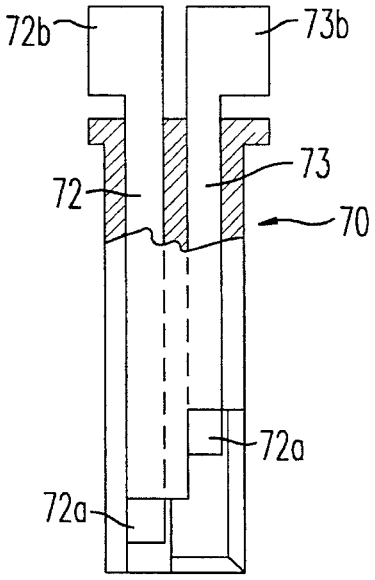
FIG. 10 shows a connection member attached to this lug.
Figure 9:
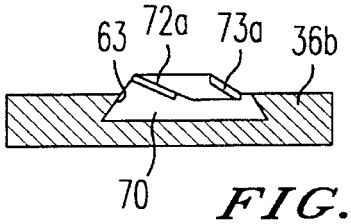
FIG. 9 is a view of one lug of the connector in section taken along line 9—9 in FIG. 8.

Referring to FIGS. 8 and 9, the lug **36*b* of the connector shown in FIG. 7 has a dovetail housing 63 adapted to accommodate a signal conductor connection member 70, the signal conductors being accommodated laterally in the trunking. The member 70 includes a insulative body 71 and two flat conductors 72, 73 disposed in this body (see FIG. 10) exposing lower contact lands 72*a*, 73*a* adapted to be connected to the signal conductors via the conductors of the contact block and upper lands 72*b*, 73*b*** to which respective branch conductors are soldered.

Obviously, numerous modifications and variations of the present invention are possible in light of the above teachings. It is therefore to be understood that within the scope of the appended claims, the invention may be practiced otherwise than as specifically described herein.

What is claimed is:

1. Branch connector for electrical trunking, the trunking containing a plurality of parallel conductors accommodated in a rigid enclosure and a plurality of branch contact blocks located in the enclosure and facing openings respectively formed in one wall of the enclosure, the connector including a branch cable connector and a body having connecting terminals respectively inserted in the contact blocks to be connected to the conductors in the trunking;

a latch mounted on the conductor body, said latch being movable manually from an unlocked position to a locked position;

the contact block including a component engaging said latch and operating a lock mechanism locking the connector body relative to the contact block upon inserting of the connector in the contact block wherein the connector has guide wells and the latch is guided by surfaces of the guide wells of the connector, the latch having one of a cam surface and a ramp engageable with the contact block so that displacement of the latch towards a lock position thereof generates a force displacing the connector in a longitudinal direction parallel to a longitudinal axis of the conductors and towards the connecting terminals.

2. Connector according to claim 1, wherein the latch includes a plunger which upon locking of the connector body is engaged in a space located in the connector body preventing access to and manual release of the latch.

3. Connector according to claim 1, wherein the connector body has a housing, the latch has a plunger which is movable from the unlocked position to the locked position of the latch and engages in the housing of the connector body, and a finger is connected to the plunger and operates the lock mechanism, the latch being movable in a transverse direction perpendicular to the plane of the wall of the enclosure which includes the openings.

4. Connector according to claim 1, wherein the latch has guide and locking lugs cooperating with the wells and engageable with and disengageable from the stop members in the longitudinal direction.

5. Connector according to claim 1, wherein the latch has guide lugs with sliding faces and have a height relative to a baseplate of the body greater than a height of the connecting terminals.

6. Connector according to claim 1, wherein the latch has a release slot formed therein.

7. Branch connector for electrical trunking, the trunking containing a plurality of parallel conductors accommodated in a rigid enclosure and a plurality of branch contact blocks located in the enclosure and facing openings respectively formed in one wall of the enclosure, the connector including a branch cable connector and a body having connecting terminals respectively inserted in the contact blocks to be connected to the conductors in the trunking;

a latch mounted on the connector body, said latch being manually movable from an unlocked position to a locked position;

the contact block including a component engaging said latch and operating said locking mechanism locking the connector body relative to the contact block upon inserting of the connector in the contact block, wherein the latch has guide lugs with sliding faces and the guide lugs have a height relative to a baseplate of the body greater than the height of the connecting terminals and wherein the locking mechanism locking the connector body comprises stop members and the guide lugs cooperate with the stop members in the contact block.

8. Branch connector for electrical trunking, the trunking including a plurality of parallel conductors accommodated in a rigid enclosure and a plurality of branch contact blocks located in the enclosure and facing openings respectively formed in one wall of the enclosure, the connector including a branch cable connector and a body having connecting terminals respectively inserted in the contact blocks to be connected to the conductors in the trunking;

a latch mounted on the connector body, said latch being movably manually from an unlocked position to a locked position;

the contact block including a component engaging said latch operating said locking mechanism locking the connector body relative to the contact block upon inserting of the connector in the contact block, wherein the contact block includes a lug with a conductive strip cooperating with a conductive part of the contact block to be grounded.

9. Branch connector for electrical trunking, the trunking containing a plurality of parallel conductors accommodated in a rigid enclosure and a plurality of branch contact blocks located in the enclosure and facing openings respectively formed in one wall of the enclosure, the connector including a branch cable connector and a body having connecting terminals respectively inserted in the contact blocks to be connected to the conductors in the trunking;

a latch mounted on the connector body, said latch being manually movable from an unlocked position to a locked position;

the contact block including a component engaging said latch operating said lock mechanism locking the connector body relative to the contact block upon inserting of the connector in the contact block, wherein the contact block includes a lug which has a housing receiving said signal conductor connection member.

* * * * *